US005865608A

United States Patent [19]

Goodman

[11] Patent Number: 5,865,608

[45] Date of Patent: Feb. 2, 1999

[54] AIR FLOW SYSTEM FOR CIRCULAR ROTARY TYPE ENGINES

[76] Inventor: William A. Goodman, 17231 Blackhawk Blvd., #104, Friendswood, Tex. 77546

[21] Appl. No.: 840,490

[22] Filed: Apr. 21, 1997

[51] Int. Cl.[6] ..... F02B 53/00

[52] U.S. Cl. ..... 418/68; 418/101

[58] Field of Search ..... 123/241; 418/68, 418/101

[56] References Cited

U.S. PATENT DOCUMENTS

| | | | |
|---|---|---|---|
| 845,973 | 3/1907 | Pape | 418/68 |
| 908,916 | 1/1909 | Weinat | 418/68 |
| 2,896,590 | 7/1959 | Bush et al. | 418/68 |
| 3,667,876 | 6/1972 | Boyd | 418/68 |

*Primary Examiner*—Michael Koczo
*Attorney, Agent, or Firm*—Kenneth A. Roddy

[57] ABSTRACT

An air flow system for circular rotary engines which provides external air intake for engine cooling and combustion chamber pressurization and faciliates increased fuel efficiency and performance for either air/fuel intake and pressured fuel injection engines. In a circular rotary engine having opposed piston rotors, exterior air is drawn into the engine through intake slots in the engine housing and is then internally pressured in opposite directions by the blades of a central separator fan toward the backside of piston rotor cooling vanes, then directed internally to impeller fans at opposite ends of the engine to increase the air flow pressure for combustion chamber injection and produce piston rotor by-pass air flow for surface cooling. In a circular rotary engine having a single piston rotor and rotor guide flange, exterior air is drawn into the engine through intake slots in the engine housing and is then directed in opposite directions by the surfaces of the rotor and guide flange surfaces toward the backside of the piston rotor cooling vanes, then directed internally to the impeller fans at opposite ends of the engine.

7 Claims, 3 Drawing Sheets

AIR FLOW SYSTEM FOR CIRCULAR ROTARY TYPE ENGINES

BACKGROUND OF THE INVENTION

1. Field of the Invention

This invention relates generally to rotary engine air flow systems, and more particularly to an air flow system for circular rotary engines which provides external air intake for engine cooling and combustion chamber pressurization and faciliates increased fuel efficiency and performance for either air/fuel intake and pressured fuel injection engines.

2. Brief Description of the Prior Art

Circular rotary engines and pumps are known in the art, wherein external type fans are used to pass air around external housing fins for cooling, and wherein intake of external air and/or fluid is used during the piston opening motion, creating a vacuum suction and subsequently vacating the chamber on the piston closure stroke or compressing for combustion, through a series of direct chamber intake and exhaust ports.

The air flow system in accordance with the present invention seeks to expand the utilitarian functions of the external air intake and internal engine air flow in circular rotary engines to provide improved engine cooling and combustion chamber pressurization and faciliate increased fuel efficiency and performance for either air/fuel intake and pressured fuel injection engines.

The air flow system in accordance with the present invention is particulary suited for applications in a circular rotary engine of the type described in applicant's U.S. Pat. No. 5,036,809 issued Aug. 6, 1991, which is hereby incorporated by reference.

The present invention is distinguished over the prior art in general, and these patents in particular by an air flow system for circular rotary engines which provides external air intake for engine cooling and combustion chamber pressurization and faciliates increased fuel efficiency and performance for either air/fuel intake and pressured fuel injection engines. In a circular rotary engine having opposed piston rotors, exterior air is drawn into the engine through intake slots in the engine housing and is then internally pressured in opposite directions by the blades of a central separator fan toward the backside of piston rotor cooling vanes, then directed internally to impeller fans at opposite ends of the engine to increase the air flow pressure for combustion chamber injection and produce piston rotor by-pass air flow for surface cooling. In a circular rotary engine having a single piston rotor and rotor guide flange, exterior air is drawn into the engine through intake slots in the engine housing and is then directed in opposite directions by the surfaces of the rotor and guide flange surfaces toward the backside of the piston rotor cooling vanes, then directed internally to the impeller fans at opposite ends of the engine.

SUMMARY OF THE INVENTION

It is therefore an object of the present invention to provide an improved air flow system for circular rotary engines.

It is another object of this invention to provide an air flow system having external air intake and multi-directional internal engine air flow circulation to provide improved engine cooling and temperature control of circular rotary engines.

Another object of this invention is to provide an air flow system having external air intake and multi-directional internal engine air flows to conduct air flows directly to each individual piston chamber for air intake, compression, and exhaust vacating after combustion for improved piston chamber cooling of circular rotary engines.

Another object of this invention is to provide an air flow system flow system having multi-directional internal engine air flows for by-pass recirculation of cooling air within the interior of circular rotary engines.

A further object of this invention is to provide an air flow system having external air intake and multi-directional internal engine air flow circulation to maintain peak efficiency of circular rotary engine performance with venting of excess internal hot air for intaking additional cooling air while maintaining efficient operating air pressure.

A still further object of this invention is to provide an air flow system which increases regulated air flow by the use of multiple internal fan blades, separator vanes, and impeller fans, in addition to the normal engine piston vacuum suction for air intake.

Other objects of the invention will become apparent from time to time throughout the specification and claims as hereinafter related.

The above noted objects and other objects of the invention are accomplished by an air flow system for circular rotary engines which provides external air intake for engine cooling and combustion chamber pressurization and faciliates increased fuel efficiency and performance for either air/fuel intake and pressured fuel injection engines. In a circular rotary engine having opposed piston rotors, exterior air is drawn into the engine through intake slots in the engine housing and is then internally pressured in opposite directions by the blades of a central separator fan toward the backside of piston rotor cooling vanes, then directed internally to impeller fans at opposite ends of the engine to increase the air flow pressure for combustion chamber injection and produce piston rotor bypass air flow for surface cooling. In a circular rotary engine having a single piston rotor and rotor guide flange, exterior air is drawn into the engine through intake slots in the engine housing and is then directed in opposite directions by the surfaces of the rotor and guide flange surfaces toward the backside of the piston rotor cooling vanes, then directed internally to the impeller fans at opposite ends of the engine.

DESCRIPTION OF THE PREFERRED EMBODIMENT

The air flow system in accordance with the present invention is particulary suited for applications in a circular rotary engine of the type described in applicant's U.S. Pat. No. 5,036,809 issued Aug. 6, 1991, which is hereby incorporated by reference. The structural components and operational features of the circular rotary engine are described in detail in U.S. Pat. No. 5,036,809.

Figure 1:
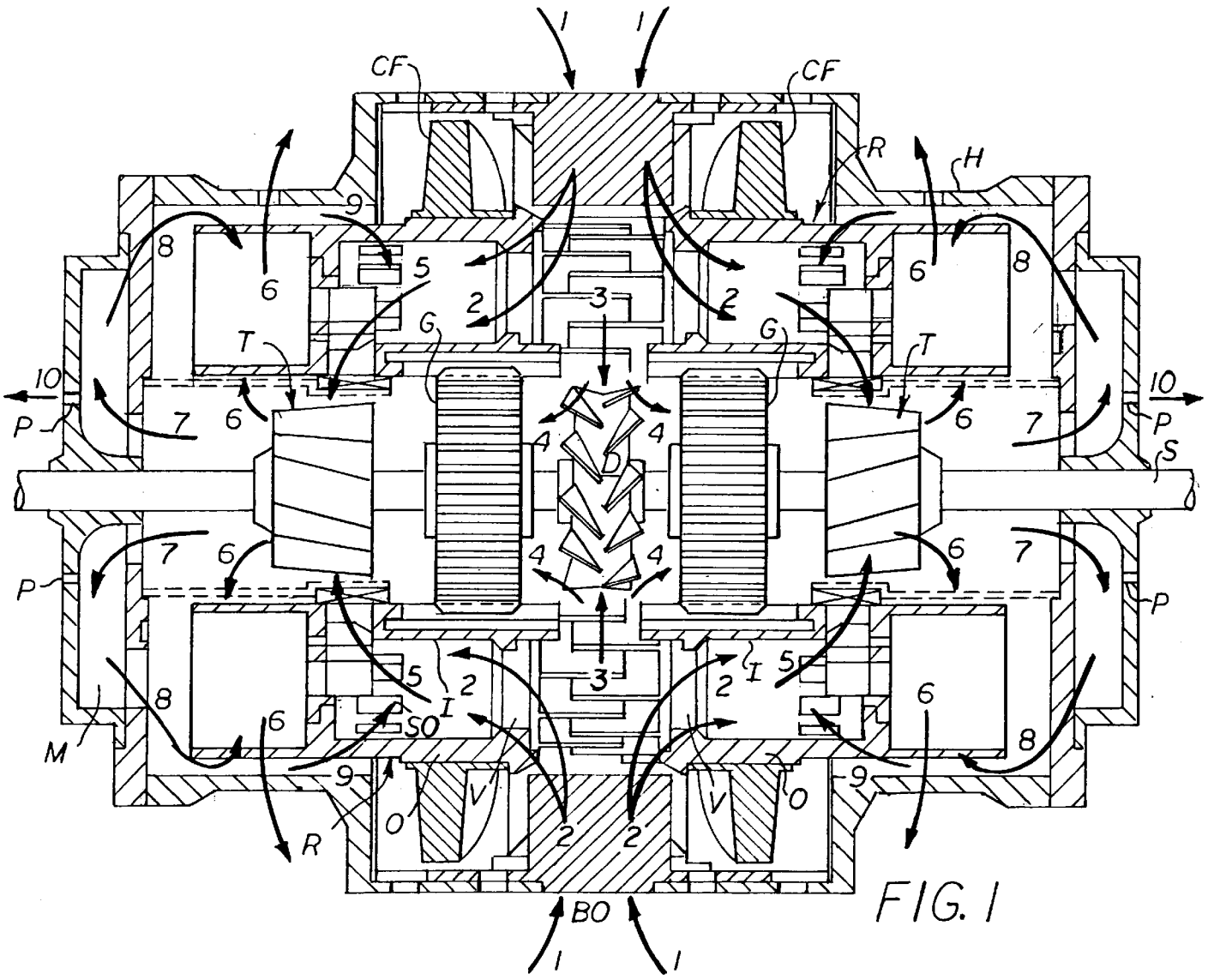
FIG. 1 is a longitudinal cross section through a circular rotary engine having two opposed separate piston rotors which rotate in synchronized same directional movement within rotor guide flanges with the intake and internal engine air flow paths represented by arrows, in accordance with the present invention.

The circular rotary engine shown in longitudinal cross section in FIG. 1 is a modification of the engine of U.S. Pat. No. 5,036,809 in that it utilizes a "split piston rotor" and dual guide flange design. In other words, it has two opposed separate piston rotors which rotate in synchronized same directional movement within two separate rotor guide control flanges that synchronize the slit piston rotor movement.

The outer housing H of the engine has a generally cylindrical side wall and end walls at each end. The housing has circumferentially spaced air intake slots through the center of the housing and exhaust ports through the side wall near each end. A pair of cylindrical piston rotors R each have a coaxial inner sleeve I and outer sleeve O with a symmetrically undulating surface at their outward facing end and interior gear teeth engaged with a drive gear G for rotating a central drive shaft S. Each piston rotor R is rotated by a radial rotor guide control flange CF secured to its exterior and connected to suitable drive means. The piston rotors R rotate while reciprocating longitudinally between end ring members positioned at the outward facing end of each piston rotor. The end rings have inwardly facing undulating surfaces symmetrical with the undulating surface of the piston rotors such that the undulating piston rotor surfaces cooperate with the end ring surfaces to alternately create a volume area and displace the volume area in some portion during rotation, thus alternately opening and closing a series of chambers at the end of each piston rotor with the reciprocating movement during axial rotation. This motion is accomplished while maintaining surface seal contact during axial reciprocation and rotary movement.

Referring to the drawings by numerals of reference, a circular rotary engine having two opposed separate piston rotors R which rotate in synchronized same directional movement driven by rotor guide control flanges CF is shown in longitudinal cross section in FIG. 1. A central separator fan D having blades extending outwardly to each lateral side is mounted at the center of the drive shaft. A impeller fan T is mounted on the drive shaft S near each outer end.

Figure 1A:
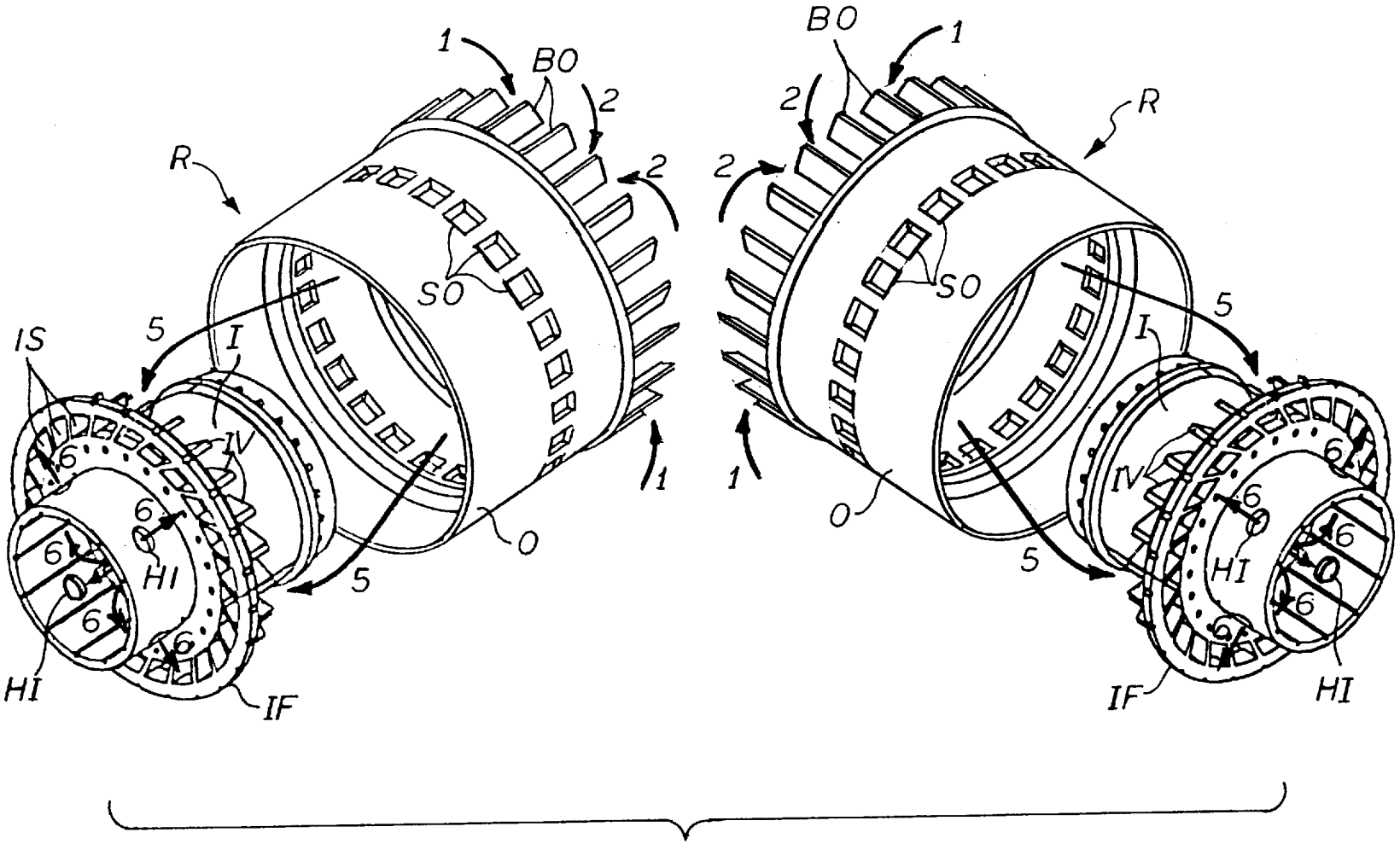
FIG. 1A is an exploded perspective view of the opposed piston rotor outer sleeves showing their center meshing fan blades and the piston rotor inner sleeves showing their mid-rotor fans and air passage slots with the directional air flow path represented by arrows.

The opposed piston rotor outer sleeves O and piston rotor inner sleeves I are shown in exploded perspective view in FIG. 1A. The other engine components are not shown in FIG. 1A to more clearly show the air flow passages of the piston rotors. The intake and directional internal engine air flow paths are represented by numbered arrows in FIGS. 1 and 1A.

Each of the piston rotor outer sleeves O has a plurality of circumferentially spaced fan blades BO at their inward facing end which are intermeshed at the center of the engine such that the piston rotor outer sleeves O rotate in the same direction in synchronization when the piston rotors are rotated. Each of the piston rotor outer sleeves O also has a plurality of circumferentially spaced air passage slots SO intermediate its opposed ends which extend through the side wall surface of the outer sleeve. Each of the piston rotor inner sleeves I has a plurality of circumferentially spaced air passage holes HI near its outer end which extend through the side wall surface of the inner sleeve.

As best seen in FIG. 1A, each piston rotor has an internal fan IF in the form of a radial flange disposed between the inner and outer sleeves which has a plurality of raised circumferentially spaced air separator vanes IV and air slots IS through its surface. Each piston rotor R also has a radial flange disposed between the inner and outer sleeves which has a plurality of radial circumferentially spaced air separator vanes V (not shown in FIG. 1A).

In operation, the intermeshed fan blades BO of the outer sleeves O draw external intake air from the exterior of the engine through the air intake slots of the engine housing, as represented by arrows 1. The air flows through the intermeshed fan blades BO into the center of the engine where it contacts and cools the interior of each piston rotor, as represented by arrows 2. The air flow is directed and pressurized by the separator vanes V between the inner and outer sleeves.

The intermeshed fan blades BO of the rotors R at the center of the engine also direct air flow from the intake slots onto the central separator fan D, as represented by arrows 3. The blades of the separator fan D divert the incoming air flow into two pressurized air flows and direct them in laterally opposed directions onto the drive gear housings G, as represented by arrows 4, where the air passes in and around the drive gear housings and toward the internal impeller fans T, along with the air passing between the piston rotor inner and outer sleeves I and O, represented by arrows 5.

The air passing betwen the inner and outer sleeves of the rotors (arrows 5) is also directed by the vanes IV and slots IS of the internal rotor fan IF onto the backside of the opposed piston rotor surfaces, thereby cooling the backside of the piston rotor surfaces.

The rotation speed of the impeller fans T is increased relative to the rotation speed of the rotor fan speeds by gear ratio differential to step-up air flow and pressure of the air passing between the inner and sleeves of the rotors.

A portion of the air pressurized by the impeller fans T is directed through the holes HI in the inner sleeve and the slots SO in the outer sleeve O and through the exhaust ports of the outer housing, represented by arrows 6, thereby providing pressurized exhaust evacuation and piston surface and chamber cooling, and chamber pressurizing during the intake cycle of the rotor.

Another portion of the air pressurized by the impeller fans T is directed toward the opposed end walls of the engine housing into a manifold area M, as represented by arrows 7, thereby cooling the outer engine housings and outer surfaces of the piston rotor head.

During the intake cycle of the rotor, the impeller pressurized air passes from the manifold M through intake ports and into the opening piston chambers, as represented by arrows 8.

Arrows 9 depict recirculating air flow passing over the inner I and outer O piston rotor sleeve surfaces into the interior area of the piston rotor R where the air flow joins the air flow (arrow 5) back through the impeller fans T, thereby completing total air flow passage around the piston rotor and chamber area surfaces as a continuous air cooling process throughout the engine cycle.

Relief valve outlet ports P may be provided in the end walls of the engine housing to vent or regulate both air temperature and the internal air pressure to maintain optimized engine operating performance under varying speeds and/or load factors. The vented air (arrows 10) also provides an auxiliary source of pressurized air.

Figure 2:
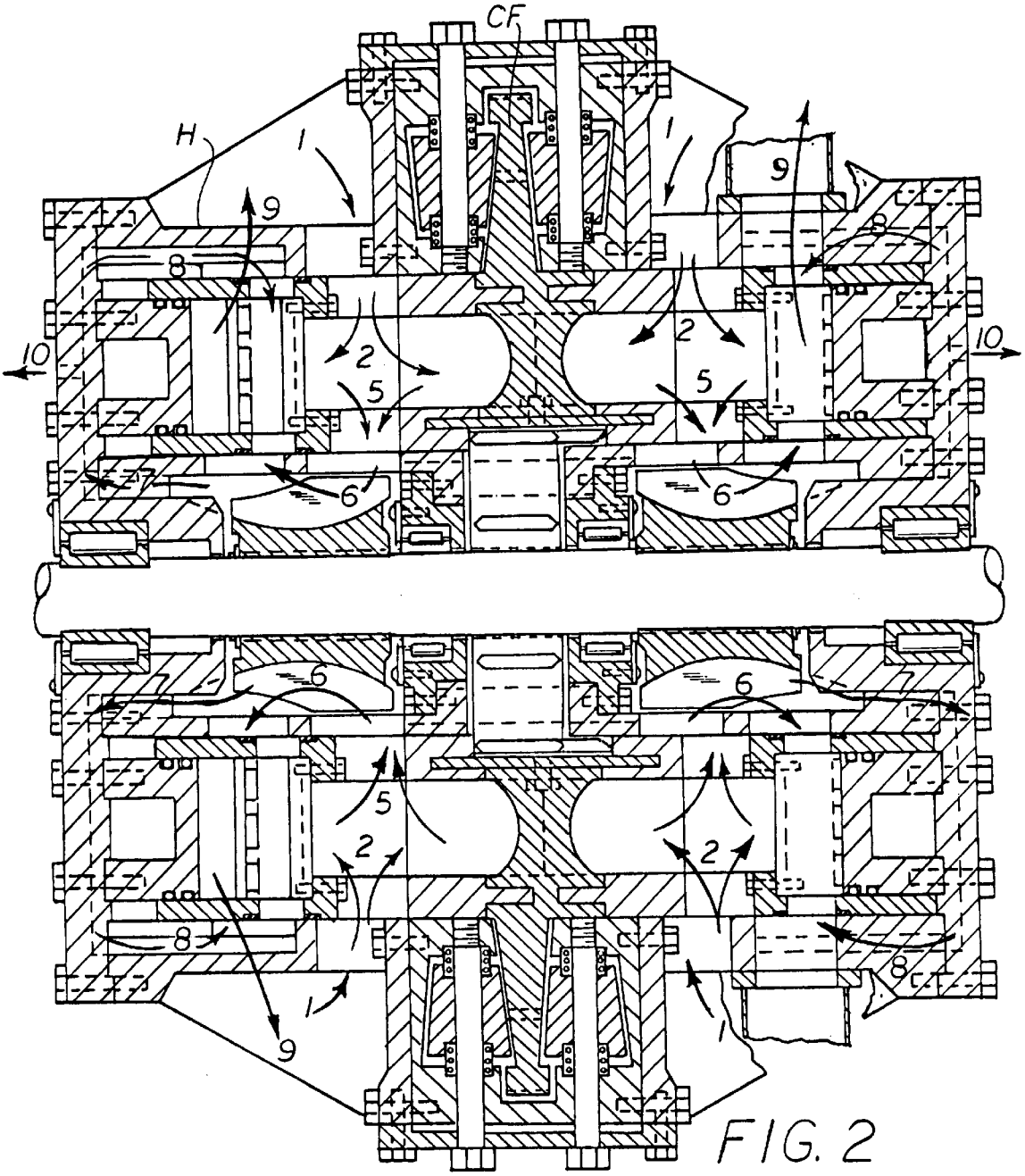
FIG. 2 is a longitudinal cross section through a circular rotary engine having a single piston rotor and rotor guide flange which rotate in the same direction with oscillation from one side of the chamber to the other side of the chamber with the intake and internal engine air flow paths represented by arrows.

FIG. 2 is a longitudinal cross section through a circular rotary engine having a single piston rotor R and rotor guide control flange CF which rotate in the same direction with oscillation from one side of the chamber to the other side of the chamber with the intake and internal engine air flow paths represented by numbered arrows. In this embodiment, there is no central separator fan D and there are no separator vanes V between the inner and outer rotor sleeves. Instead, intake air drawn into the interior of the engine is separated and redirected by the opposed surfaces of the central piston rotor and rotor guide control flange. The operation and air flow passages are the same as described above with reference to FIGS. 1 and 1A, and the arrows representing the air flow are given the same numerals of reference, but their detailed description will not be duplicated to avoid repetition.

While this invention has been described fully and completely with special emphasis upon preferred embodiments, it should be understood that within the scope of the appended claims the invention may be practiced otherwise than as specifically described herein.

I claim:

1. An air flow system for circular rotary engines of the type having an engine housing with a generally cylindrical side wall and end walls at each end, a pair of cylindrical piston rotors mounted therein for simultaneous axial rotation and reciprocating longitudinal movement and each having a coaxial inner sleeve and outer sleeve with a symmetrically undulating surface at an outward facing end and interior gear teeth engaged with a drive gear for rotating a central drive shaft, a pair of opposed end rings near each end of said housing each having inwardly facing undulating surfaces symmetrical with the undulating surfaces of each said piston rotor such that the undulating surfaces cooperate to alternately create a volume area and displace the volume area in some portion during rotation thereby alternately opening and closing a series of chambers at the end of each said piston rotor with the reciprocating movement during axial rotation, said air flow system comprising:

a plurality of circumferentially spaced air intake ports and exhaust ports through said housing side wall, said intake ports disposed near the center of said housing and said exhaust ports disposed near each end thereof;

a plurality of circumferentially spaced fan blades at an inward facing end of said piston rotor outer sleeve configured to draw exterior air through said intake ports upon rotation, into said housing, and between said piston rotor inner and outer sleeves, thereby cooling the interior surfaces of said piston rotor;

air flow diverting means at the center of said engine configured to receive air from said piston rotor fan blades and direct it between each said piston rotor inner and outer sleeves toward their outward facing ends and onto said drive gear thereby cooling the interior surfaces of said inner and outer piston rotor sleeves and drive gear.

2. An air flow system according to claim 1 wherein said air flow diverting means comprises:

a central separator fan mounted on said drive shaft having blades configured to receive air from said piston rotor outer sleeve fan blades and divert it onto said drive gear thereby cooling said drive gear; and a plurality of circumferentially spaced air separator vanes extending radially between said piston rotor inner and outer sleeves near their inward facing end configured to pressurize and pass air between said piston rotor inner and outer sleeves toward their outward facing ends.

3. An air flow system according to claim 1 further comprising:

a plurality of circumferentially spaced air passage slots extending through the side wall of said piston rotor outer sleeve intermediate opposed ends thereof;

a plurality of circumferentially spaced air passage holes extending through the side wall of said piston rotor inner sleeve near its outward facing end;

an impeller fan mounted on said drive shaft spaced outwardly from said drive gear having blades configured to receive air passing from said drive gear and through said piston rotor inner and outer sleeves, pressurize it, and direct a portion of said pressurized air through said holes in said inner sleeve, through said slots in said outer sleeves, and through said exhaust ports in said outer housing, thereby providing pressurized exhaust evacuation and piston surface and chamber cooling, and chamber pressurizing during the intake cycle of said piston rotor;

said impeller fan blades directing another portion of said pressurized air toward a manifold area in the end wall of said housing, thereby cooling the engine housing and outer surfaces of said piston rotor; and during the intake cycle of said piston rotor, a portion of said air pressurized by said impeller fan blades being drawn from said manifold area and into said alternately opening chambers; and another portion of said air pressurized by said impeller fan blades being directed toward said inward facing ends of said piston rotor inner and outer sleeves to be mixed with the air passing from said drive gear and through said piston rotor inner and outer sleeves and recirculate the mixed air back to said impeller fan.

4. An air flow system according to claim 1 further comprising:

an internal fan disposed between said piston rotor inner and outer sleeves near the outward facing ends thereof having a plurality of circumferentially spaced air separator vanes and air slots through its surface configured to receive air passing between said piston rotor inner and outer sleeves and direct it onto outward facing surfaces of said piston rotor, thereby cooling the outward facing surfaces of said piston rotor.

5. An air flow system according to claim 1 further comprising:

relief valve outlet ports in the end walls of said engine housing for selectively venting and regulating both air temperature and internal air pressure to maintain optimized engine operating performance under varying speeds and/or load factors.

6. An air flow system according to claim 1 further comprising:

outlet ports in the end walls of said engine housing for selectively venting internal pressurized air to be used as an auxiliary source of pressurized air.

7. An air flow system according to claim 1 wherein said piston rotors are rotatably mounted in opposed relation with said circumferentially spaced fan blades at said inward facing ends of said piston rotor outer sleeves being intermeshed such that said piston rotors rotate in the same direction and reciprocate in axially opposed directions.

* * * * *